US010583457B2

(12) United States Patent
Ando et al.

(10) Patent No.: US 10,583,457 B2
(45) Date of Patent: Mar. 10, 2020

(54) ELECTRONIC COMPONENT HAVING PRINTING AND METHOD OF MANUFACTURING THE SAME

(71) Applicant: Taiyo Yuden Co., Ltd., Tokyo (JP)

(72) Inventors: Hideo Ando, Tokyo (JP); Chiharu Hayashi, Tokyo (JP); Toshimasa Suzuki, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 313 days.

(21) Appl. No.: 15/450,234

(22) Filed: Mar. 6, 2017

(65) Prior Publication Data

US 2017/0368570 A1 Dec. 28, 2017

(30) Foreign Application Priority Data

Jun. 22, 2016 (JP) ..... 2016-123389

(51) Int. Cl.
*B05D 3/06* (2006.01)
*H01F 41/04* (2006.01)
(Continued)

(52) U.S. Cl.
CPC ..... *B05D 3/06* (2013.01); *H01F 17/0013* (2013.01); *H01F 27/245* (2013.01); *H01F 41/02* (2013.01);
(Continued)

(58) Field of Classification Search
USPC ..... 428/426, 428, 432, 688
See application file for complete search history.

(56) References Cited

U.S. PATENT DOCUMENTS 5,002,903 A * 3/1991 Lim ..... C03C 8/04 501/10
6,238,847 B1 * 5/2001 Axtell, III ..... B41M 5/262 427/555

FOREIGN PATENT DOCUMENTS

JP 08-031682 2/1996
JP 08-031682 A 2/1996
(Continued)

OTHER PUBLICATIONS

Notification of Reasons for Refusal issued in corresponding Japanese Patent Application No. 2016-123389 dated Jul. 26, 2018 with English translation.

(Continued)

*Primary Examiner* — Lauren R Colgan
(74) *Attorney, Agent, or Firm* — Pillsbury Winthrop Shaw Pittman, LLP

(57) ABSTRACT

To provide an electronic component having printing, which can achieve both of a moisture resistance capability and visibility of printing, and a method of manufacturing the same. A method of manufacturing an electronic component having printing, including preparing an electronic component before being subjected to printing, which is provided with a magnetic element body made of an alloy magnetic material containing a transition metal on a surface thereof, and a glass layer that contains Bi with which the magnetic element body is at least partly coated and does not contain a transition metal, and irradiating the electronic component before being subjected to printing with laser light having a wavelength of 1064 nm so that the laser light is transmitted through the glass layer, so that a printing portion is formed at a partial glass portion in a vicinity of an interface between the magnetic element body and the glass layer.

6 Claims, 6 Drawing Sheets

(51) Int. Cl.

| | |
|---|---|
| ***H01F 17/00*** | (2006.01) |
| ***H01F 27/245*** | (2006.01) |
| ***H01F 41/02*** | (2006.01) |
| *H01F 27/28* | (2006.01) |

(52) U.S. Cl.
CPC ..... *H01F 41/046* (2013.01); *H01F 27/2804* (2013.01); *H01F 2017/0066* (2013.01); *H01F 2027/2809* (2013.01)

(56) References Cited

FOREIGN PATENT DOCUMENTS

| | | | |
|---|---|---|---|
| JP | 2008-205353 | A | 9/2008 |
| JP | 2009-000704 | A | 8/2009 |
| JP | 2011-233468 | A | 11/2011 |

OTHER PUBLICATIONS

Notification of Reasons for Refusal issued in corresponding Japanese Patent Application No. 2016-123389 dated Nov. 13, 2018 with English translation.
Non-final Office Action dated Feb. 26, 2019 issued in corresponding Taiwanese Patent Application No. 106110096 with English translation.

* cited by examiner

| | | | | (A) | (B) | (C) | (D) | (E) |
|---|---|---|---|---|---|---|---|---|
| | N = 20 | Condition | Output | 7.15 W | 7.75 W | 8.35 W | 8.35 W | 9.05 W |
| | | | No. of Times Printing Is Performed | 4 | 3 | 3 | 2 | 2 |
| (1) | Glass Thickness | 10 μm | Rank A | 14 | 13 | 9 | 11 | 10 |
| | | | Rank B | 3 | 4 | 7 | 6 | 5 |
| | | | Rank C | 3 | 3 | 4 | 3 | 5 |
| | | | Determination | NG | NG | NG | NG | NG |
| (2) | | 20 μm | Rank A | 20 | 18 | 18 | 15 | 13 |
| | | | Rank B | 0 | 2 | 2 | 4 | 4 |
| | | | Rank C | 0 | 0 | 0 | 1 | 3 |
| | | | Determination | E | G | G | NG | NG |
| (3) | | 25 μm | Rank A | 20 | 20 | 19 | 16 | 14 |
| | | | Rank B | 0 | 0 | 1 | 2 | 4 |
| | | | Rank C | 0 | 0 | 0 | 2 | 2 |
| | | | Determination | E | E | G | NG | NG |
| (4) | | 30 μm | Rank A | 20 | 20 | 20 | 20 | 20 |
| | | | Rank B | 0 | 0 | 0 | 0 | 0 |
| | | | Rank C | 0 | 0 | 0 | 0 | 0 |
| | | | Determination | E | E | E | E | E |

E (Excellent) Rank A Only G (Good) Ranks A and B NG (Not Good) Rank C Included

Fig. 6

ELECTRONIC COMPONENT HAVING PRINTING AND METHOD OF MANUFACTURING THE SAME

CROSS-REFERENCE TO RELATED APPLICATIONS

This application is based on and claims the benefit of priority from Japanese Patent Application Serial No. 2016-123389 (filed on Jun. 22, 2016), the contents of which are hereby incorporated by reference in their entirety.

TECHNICAL FIELD

The present invention relates to an electronic component having printing and a method of manufacturing the same.

BACKGROUND

In response to a social trend toward energy saving and awareness of environmental ecology, electronization has advanced also in the field of automobiles, so that more electronic components are mounted on a periphery of their driving systems, which has led to a growing demand for durability and stability of such electronic components under a high temperature environment. Accordingly, also in the field of inductors, there have been developed products made mainly of a metal material that is a magnetic material having a stable saturation magnetic flux density under a high-temperature environment. Moreover, inductors made of a metal magnetic material are requested to have not only a high-temperature environment capability but also high reliability capabilities such as a moisture resistance capability, a corrosion resistance capability, and so on that are as stable as those of conventional inductors made of a ferrite magnetic material. It is, therefore, also desired that a printing process with respect to such products should not impair these capabilities. Particularly, laser printing, which has recently been used for performing printing on electronic components, has a lot of advantages from the viewpoint of a mass production process. With respect to a metal material, however, the laser printing destroys an insulation coating formed on a metal surface, and thus the use thereof has been avoided.

In printing using laser light with respect to electronic components including those to which a glass coating is applied such as, among others, an inductor (a metal material), as shown in Japanese Patent Application Publication No. Hei 8-31682 (hereinafter "the '682 Publication"), a glass surface and a surface of a matrix thereof itself are ground into a concave state, and light dispersion and a difference in refraction index resulting therefrom are utilized to obtain visibility.

In the technique disclosed in the '682 Publication, a glass surface and a surface of a matrix of an electronic component itself are ground into a concave state, so that a printing portion of a metal core to which a glass coating is applied for the purpose of rust prevention has a decreased glass film thickness. Because of this, intrinsic functions such as, among others, a moisture resistance capability is decreased, leading to a problem that rust becomes likely to be formed. Furthermore, in a case of a metal core to which no glass coating is applied, a thin insulation coating layer formed on a surface of a metal material is destroyed, leading to problems of formation of rust and degradation in insulation capability. Furthermore, in manufacturing, dust originating in glass or a metal material matrix is generated, so that it is required that a process of collecting the dust be newly added, thus making this printing method costly.

SUMMARY

With these in view, the present invention has as its object to provide an electronic component having printing, which can achieve both of a moisture resistance capability and visibility of printing, and a method of manufacturing the same.

As a result of intensive studies, the investors of the present invention have completed the present invention that is characterized as follows: In the manufacturing method of the present invention, an electronic component before being subjected to printing is prepared, which is provided with a magnetic element body made of an alloy magnetic material containing a transition metal on a surface thereof, and a glass layer that contains Bi with which the magnetic element body is at least partly coated and does not contain a transition metal, and the electronic component before being subjected to printing is irradiated with laser light having a wavelength of 1064 nm so that the laser light is transmitted through the glass layer, so that a printing portion is formed at a partial glass portion in a vicinity of an interface between the magnetic element body and the glass layer. An electronic component having printing is obtained in this manner.

Advantages

According to the present invention, printing with high visibility can be performed without causing a scratch on the glass layer or a surface of the magnetic element body.

BRIEF DESCRIPTION OF THE DRAWINGS

FIG. 6 illustrates an example of printing results obtained by laser irradiation.

DESCRIPTION OF THE PREFERRED EMBODIMENTS

Figure 1:
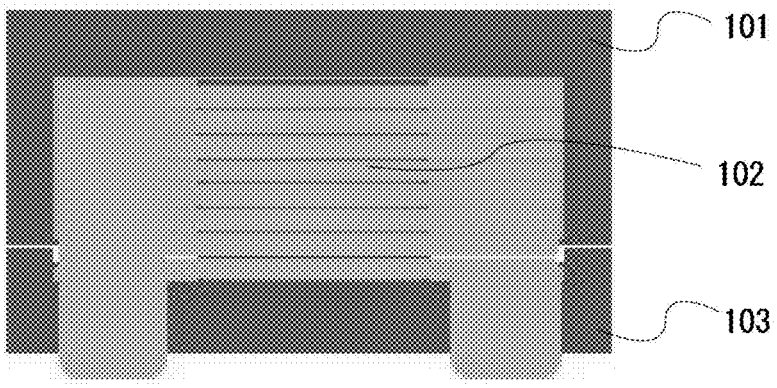
FIG. 1 is a schematic sectional view of one example of an electronic component.

With reference to the appended drawings as appropriate, the following describes the present invention in detail. It is to be noted, however, that the present invention is not limited to an illustrated aspect. Furthermore, in the appended drawings, portions characteristic of the present invention may be depicted in a highlighted manner, and, therefore, accuracy in the scale to which various portions are drawn in the drawings is not necessarily ensured.

FIG. 1 is a schematic sectional view of one example of an electronic component. An electronic component of the present invention may be provided at least with a magnetic element body and a glass layer. In the aspect shown in FIG. 1, there are depicted a coil 102 that may be formed of a conductor formed in the shape of a spiral or the like and magnetic element bodies 101 and 103 provided around the coil 102.

The magnetic element body may be made of an alloy magnetic material. The magnetic element body in its entirety may be understood as being an aggregate body formed of a multitude of alloy magnetic particles bonded to each other, which may be originally independent of each other. It can also be said that the magnetic element body may be a compressed powder body formed of a multitude of alloy magnetic particles. At least some of the alloy magnetic particles each may have an oxide film formed on at least part of a circumference thereof, preferably, on a substantially entire circumference thereof, and an insulation property of the magnetic element body may be secured by the oxide film. The alloy magnetic particles may contain at least one type of transition metal, a typical example of which is iron (Fe). In this specification, while Fe may be described as a representative of transition metals, a transition metal that can be used is not limited to Fe. Preferably, the alloy magnetic particles may also contain an element other than Fe. As the element other than Fe, preferably, one or more of Si, Zr, Ti, and Ni are used.

At least some of the individual alloy magnetic particles each may have an oxide film formed on at least part of a circumference thereof. The oxide film may have been formed in a stage in which the magnetic element body may be raw material particles before being formed into the magnetic element body, or may be so formed that, in the stage in which the magnetic element body may be raw material particles, no oxide films may be present or an extremely small number of oxide films may be present, and oxide films may be fully formed in the course of a process of molding the magnetic element body. Preferably, the oxide film may be formed as a result of the alloy magnetic particles themselves being oxidized. The presence of the oxide film may ensure an insulation property of the magnetic element body in its entirety.

As for aspects and manufacturing method of the magnetic element body, prior art can be referred to as appropriate. For example, the magnetic element body may be obtained by embedding a spiral-shaped insulation conductive wire in alloy magnetic particles, followed by heating and pressing the alloy magnetic particles. According to another aspect, a laminated inductor may be formed by printing, in a predetermined pattern, a paste containing conductor particles on a green sheet containing alloy magnetic particles, laminating such green sheets on which the printing has been performed to each other, and pressing and heating the green sheets. In that case, an insulation body portion generated deriving from the alloy magnetic particles can be construed as being a magnetic element body.

According to the present invention, the magnetic element body may contain a transition metal at at least part of a surface thereof and is coated with the glass layer. It is sufficient that the magnetic element body may be at least partly coated with the glass layer, and preferably, the magnetic element body may be coated therewith in its entirety. The coating with the glass layer may be performed prior to after-mentioned printing. In other words, in the electronic component before being subjected to printing, the surface of the magnetic element body may be coated with the glass layer. There is no particular limitation on how the coating with the glass layer is performed, and any conventionally known method can be adopted.

According to the present invention, a glass material constituting the glass layer may contain Bi. Since Bi may be contained in the glass layer, an improvement in visibility may be achieved as a result of the after-mentioned printing. It is presumed that a transition metal element in the magnetic element body, such as Fe or the like, may be diffused by laser irradiation for printing, and due to the diffusion, a compound containing Bi, which may be contained in a portion of the glass layer in a neighborhood thereof, may be segregated, thus contributing to an improvement in visibility. In the glass layer, Bi may be contained, preferably, in a concentration of 50 to 90 wt % in terms of $Bi_2O_3$. In the present invention, in a stage prior to laser irradiation for printing, a transition metal may not be contained in the glass material constituting the glass layer. Here, the fact that a transition metal may not be contained therein means that there may occur no reaction to laser light, and a transition metal in the glass material may have a concentration of, for example, not more than 1%, though depending on an intensity of laser light that may be used. The presence of such a transition metal may degrade a transmission property of glass, thus making it hard for laser light to reach a layer containing the transition metal on a surface of a component element body. When laser light of the same output level is used, an amount of energy reaching there may be decreased, and when increased laser energy is used, processing of glass may occur, which may be inappropriate.

The glass layer may have a thickness of, preferably, not less than 30 μm. The presence of the glass layer having a thickness of not less than 30 μm may significantly reduce adverse effects such as occurrence of a crack in surface layers of glass and the magnetic element body due to, for example, expansion caused by heat generated in laser processing, as a result of which printing with high visibility can be achieved. There is no particular limitation on an upper limit of the thickness of the glass layer, and the glass layer may have a thickness of a general-purpose glass coating, i.e., a thickness of about 100 μm. Preferably, from the viewpoint of a production cost and a minimum possible amount of glass used, the upper limit of the thickness of the glass layer may be about 40 μm, which is somewhat thicker than 30 μm.

Figure 2:
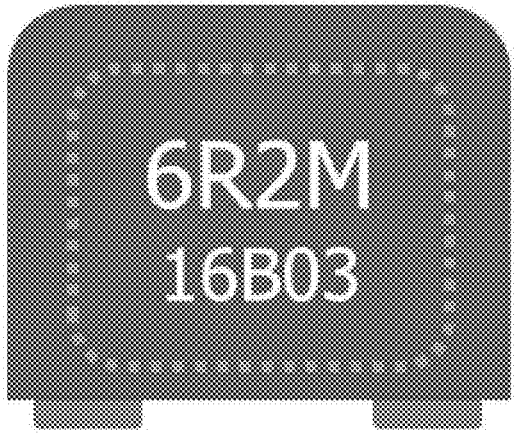
FIG. 2 illustrates an example of printing on the electronic component.

With respect to the above-mentioned electronic component before being subjected to printing, which may have the glass layer as a coating, printing may be performed by laser irradiation. Laser light used for printing may have a wavelength of 1064 nm. FIG. 2 illustrates an example of printing, and printing may be in the form of characters such as product reference symbols and so on, graphics, or a combination of characters and graphics. Laser irradiation may be performed such that laser light may be transmitted through the above-mentioned glass layer to reach the surface of the magnetic element body, and thus printing may be made on a partial glass portion in a vicinity of an interface between the magnetic element body and the glass layer.

Figure 3A:
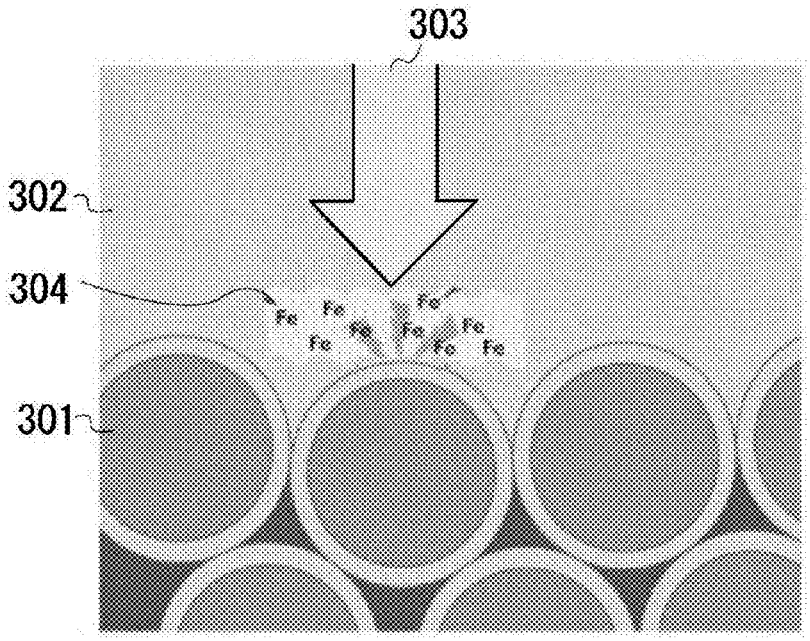
FIG. 3A illustrates a schematic view of an estimated mechanism of how printing is made.
Figure 3B:
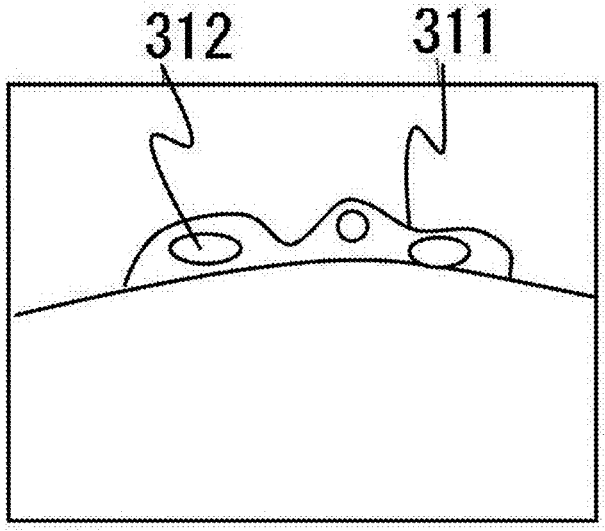
FIG. 3B illustrates a schematic view of an estimated mechanism of how printing is made.

FIGS. 3A and 3B illustrate schematic views of an estimated mechanism of how printing is made. As depicted in FIG. 3A, the magnetic element body formed of alloy magnetic particles 301 in an aggregated state and a glass layer 302 may be present, forming an electronic component before being subjected to printing. Laser light 303 having a wavelength of 1064 nm may be transmitted through the glass layer 302 that, in its initial state, may not contain a transition metal, and a laser beam may exhibit a relatively high absorptivity with respect to a transition metal, such as Fe or the like, in the alloy magnetic particles 301. Because of this, in a vicinity 304 of an interface between the magnetic element body and the glass layer, a transition metal such as Fe or the like may be locally heated by laser light, and a portion of the glass layer that may be in contact with the transition metal thus heated may be locally heated, so that a transition metal element may be diffused from the magnetic element body into the glass layer and the diffusion may advance. Moreover, the portion of the glass layer in which the transition metal element may be diffused may increase in absorptivity of laser light, and thus in addition to the surface of the magnetic element body, the portion of the glass layer in which the transition metal may be diffused may be also caused to locally generate heat by laser light. Due to this heat generation and the diffused transition metal, a compound containing Bi in a changed state may be precipitated at a portion of the glass layer in a vicinity of an interface of the magnetic element body with the glass layer. The presence of such a diffusion portion in which a transition metal such as Fe or the like may be diffused into the glass layer in the vicinity of the interface between the magnetic element body and the glass layer and the presence of the compound containing Bi may improve visibility of printing.

FIG. 3B is an enlarged sectional schematic view of a traced observation image, which is obtained by using a microscope, of the vicinity of the interface between the magnetic element body and the glass layer after printing. An Fe diffusion 311 from the magnetic element body and a Bi segregation 312 from the glass layer are observed, and these can be easily detected and identified by EDX analysis or the like. In a non-printing portion, for example, a portion of the glass layer on a different portion of the surface of the magnetic element body, or a portion of the glass layer on the same portion of the surface of the magnetic element body, which is obviously apart from a color-changed portion resulting from printing, may not contain Fe in a content sufficient to react to laser light. In a printing portion, in a glass portion in the vicinity of the interface of the magnetic element body, a diffusion of Fe can be easily detected. Compared with a Bi content in a portion of the glass layer in the non-printing portion, a Bi content in the glass portion at the interface of the magnetic element body in the printing portion may be greater by not less than 10%, and thus a segregation of Bi can be easily detected therein.

There is no particular limitation on, for example, conditions for performing laser irradiation, prior art can be referred to as appropriate. That is, with a too low laser output, there may occur no processing, while with a too high laser output, laser light may penetrate through a processed article or cause damage to the processed article, and thus optimizing a laser output as appropriate falls within prior art. Furthermore, laser irradiation may be performed a plurality of number of times so that a laser output used every time the irradiation is performed may be suppressed, thereby reducing damage to a processed article, and this also falls within related arts. Also in the present invention, with a too low laser output, printing cannot be performed, while with a too high laser output, processing of the magnetic element body may occur to cause damage, because of which a laser output may be optimized as appropriate, and laser irradiation may be performed a plurality of number of times so that processing of the magnetic element body and damage may be prevented from occurring, and thus there can be obtained conditions for performing laser irradiation, under which appropriate printing may be performed. For example, by using a peak output of 7 to 8.5 W, laser irradiation may be performed three to four times, and thus a further improvement in visibility of printing can also be achieved. An electronic component having printing can be obtained in this manner. The electronic component having printing obtained in this manner is also one embodiment of the present invention.

According to a manufacturing method of the present invention, printing may be performed without causing a scratch on a surface of a magnetic element body provided with a glass coating, the printing may be made in a visible state and can be recognized in image processing, and a high solvent resistance can be secured. There can also be expected an effect that generation of dust in a manufacturing process is prevented. Furthermore, in an electronic component formed by using this printing method, a printing portion may be protected inside the glass coating and may not be exposed directly to air, thus being less prone to the influence of oxygen in the air or moisture. Particularly under a high temperature, this effect may be remarkably exerted, and thus a high heat resistance may be obtained, and visibility may be less likely to be degraded even at 550° C.

Figure 4A:
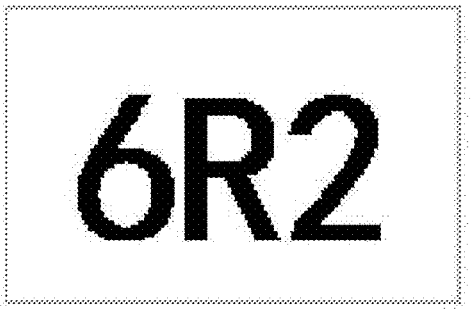
FIGS. 4A to 4C are diagrams explaining ranking of examples of printing results obtained by laser irradiation.
Figure 4B:
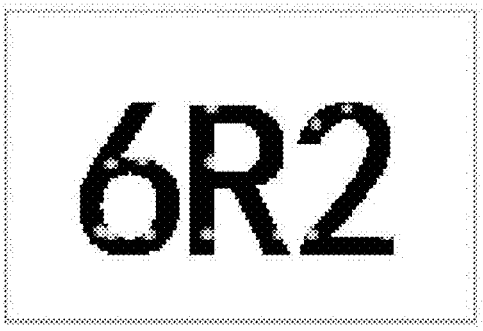
Figure 4C:
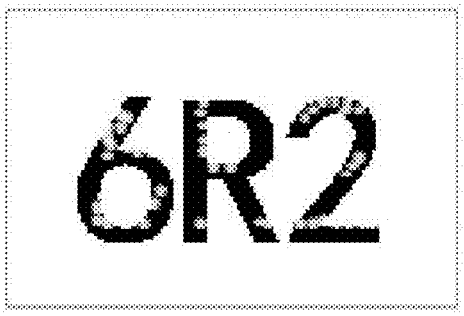

FIG. 4 illustrates an example of printing results obtained by laser irradiation. Drawings in FIG. 4 are traced images of photographed printing made by laser irradiation on an electronic component before being subjected to printing, which may be provided with a glass layer. FIG. 4A shows a good-quality product in rank A in which no printing defect may be found in 100% of an area of a printing area. Rank A is a highly excellent level at which normal characters can be recognized, and bar codes can also be recognized. FIG. 4B shows a good-quality product in rank B in which no printing defect may be found in 90% of an area of a printing area. Rank B may apply to products having no printing defect in not less than 90% and less than 100% of an entire area thereof. At Rank B, normal characters can be recognized, and as for bar cords, while two-dimensional bar cords are hardly recognizable, simpler line-shaped bar codes can be recognized, so that no problem may arise in normal printing. FIG. 4C shows a working product in rank C in which no printing defect may be found in 70% of an area of a printing area. Rank C may apply to products having no printing defect in 70 to 90% of an entire area thereof. This may be a level at which while normal characters can be recognized, recognition of bar codes, regardless of whether they are line-shaped or two-dimensional, may be hindered, and may be a usable level for purposes other than printing bar codes. A printing defect may refer to a color-undeveloped portion in the printing area, in which the magnetic element body may be exposed, and a portion in the printing area, in which damage may have occurred to the glass layer or a surface of the magnetic element body. Such printing defect may be easily identified by visual observation or the like. In ranking printing defects, however, in an image photographed with a camera, a portion having a brightness higher by not less than 15% than a normal printing portion may be defined as a printing defect and categorized based on a size of an area thereof.

Figure 5A:
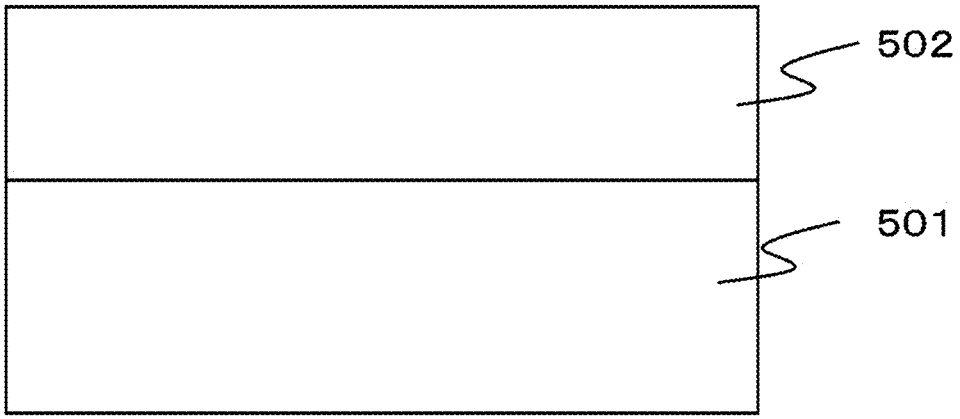
FIG. 5A illustrates a sectional schematic view of a vicinity of an interface between a magnetic element body and a glass layer after laser irradiation.
Figure 5B:
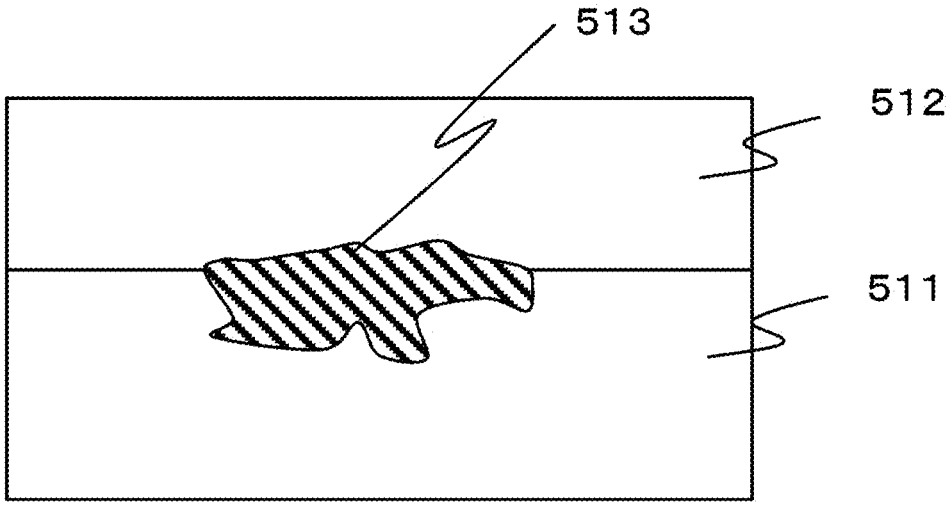
FIG. 5B illustrates a sectional schematic view of a vicinity of an interface between a magnetic element body and a glass layer after laser irradiation.

FIGS. 5A and 5B illustrate sectional observation images of a vicinity of an interface between the magnetic element body and the glass layer after laser irradiation. FIG. 5A shows an observation image obtained after performing laser irradiation four times under a condition of a peak output of 7.15 W, in which a magnetic element body 501 and a glass layer 502 were observed. FIG. 5B shows an observation image obtained after performing laser irradiation four times under a condition of a peak output of 8.35 W, in which a magnetic element body 511, a glass layer 512, and a damage portion 513 of the magnetic element body were observed.

FIG. 6 illustrates an example of printing results obtained by laser irradiation. There are shown results of performing printing by using glass layers of different thicknesses and under different conditions for performing laser irradiation. In rows (1) to (4), there are shown printing results in cases of using the glass layers having a thickness of 10 μm, 20 μm, 25 μm, and 30 μm, respectively. In columns (A) to (E), there are shown printing results in cases of using, as a condition for performing laser irradiation, a peak output of 7.15 W (irradiation performed four times), a peak output of 7.75 W (irradiation performed three times), a peak output of 8.35 W (irradiation performed three times), a peak output of 8.35 W (irradiation performed twice), a peak output of 9.05 W (irradiation performed twice), respectively.

For these cases of printing, in the case of using the glass layer having a thickness of 30 μm, regardless of the conditions for performing laser irradiation, visibility obtained was in rank A only and thus was significantly excellent, while in the cases of using the glass layer having a thickness of 20 μm and the glass layer having a thickness of 25 μm, respectively, only in the cases of using a peak output is 7.15 W (irradiation performed four times), a peak output of 7.75 W (irradiation performed three times), and a peak output of 8.35 W (Irradiation performed three times), respectively, visibility obtained was in rank A and rank B and thus was excellent. In cases other than those, printing was visible but visibility obtained was in lower ranks including rank C, which can hardly be said to be preferable from the viewpoint of image recognition, resulting in good but not significantly excellent quality.

What is claimed is:

1. A method of manufacturing an electronic component having printing, comprising:

preparing an electronic component having no printing, the electronic component including a magnetic element body and a glass layer, the magnetic element body being made of an alloy magnetic material containing a transition metal on a surface thereof, the glass layer containing Bi with which the magnetic element body is at least partly coated, and the glass layer containing no transition metal, and irradiating the electronic component having no printing with laser light so that the laser light is transmitted through the glass layer, so that a printing portion is formed at a partial glass portion in a vicinity of an interface between the magnetic element body and the glass layer, and wherein the printing portion contains transition metal and a compound containing Bi.

2. The method of manufacturing an electronic component according to claim 1, wherein the glass layer has a thickness of not less than 30 μm.

3. An electronic component having printing, comprising: a magnetic element body and a glass layer, the magnetic element body being made of an alloy magnetic material containing a transition metal on a surface thereof; the glass layer containing Bi with which the magnetic element body is at least partly coated, wherein the glass layer contains no transition metal in a non-printing portion, and printing made by laser light is present in a partial glass portion in a vicinity of an interface between a surface of the magnetic element body and the glass layer, and wherein the printing contains transition metal and a compound containing Bi.

4. The electronic component according to claim 3, wherein the transition metal is present in the partial glass portion in the vicinity of the interface between the surface of the magnetic element body and the glass layer.

5. The electronic component according to claim 3, wherein in the partial glass portion in the vicinity of the interface between the surface of the magnetic element body and the glass layer, Bi is present in a content greater by not less than 10 wt % than in the non-printing portion of the glass layer.

6. The electronic component according to claim 3, wherein the glass layer has a thickness of not less than 30 μm.

* * * * *